US006026664A

United States Patent [19]

Lin

[11] Patent Number: 6,026,664

[45] Date of Patent: Feb. 22, 2000

[54] STEEL WIRE ROPE LOCK

[76] Inventor: Yung-Ta Lin, No. 67, Wen-An Street, Tainan, Taiwan

[21] Appl. No.: 09/246,943

[22] Filed: Feb. 9, 1999

[51] Int. Cl.[7] ..... E05B 67/06

[52] U.S. Cl. ..... 70/49; 70/18

[58] Field of Search ..... 70/14, 18, 19, 70/30, 49, 38, 386

[56] References Cited

U.S. PATENT DOCUMENTS

| | | | |
|---|---|---|---|
| 4,044,577 | 8/1977 | Horlacher | 70/49 X |
| 5,440,904 | 8/1995 | Su | 70/49 X |
| 5,447,043 | 9/1995 | Hwang | 70/49 |
| 5,568,740 | 10/1996 | Lin | 70/49 |
| 5,752,416 | 5/1998 | Nien | 70/49 X |

FOREIGN PATENT DOCUMENTS

| | | | |
|---|---|---|---|
| 2240578 | 8/1991 | United Kingdom | 70/49 |

*Primary Examiner*—Suzanne Dino Barrett
*Attorney, Agent, or Firm*—Rosenberg, Klein & Lee

[57] ABSTRACT

A steel wire rope lock includes a lock housing, a steel wire rope having a first end and a second end, a first end connector for fixing tightly the first end of the steel wire rope, a second end connector for fixing tightly the second end of the steel wire rope and a lock fitted in the lock housing. The first end connector is inserted into the mouth of the lock housing. The lock is inserted in the other end of the lock housing. Then, the second end connector is inserted into the lateral hole of the lock housing, and the steel bead provided half in the round hole of the second end connector is compressed by the inner wall of the lateral hole to withdraw wholly in the round hole. When the second end connector being inserted more downwardly, the steel bead will be pushed outward by the spring in the round hole to be caught in the arc groove. Thus, the second end connector is firmly fixed in the lock housing.

1 Claim, 4 Drawing Sheets

STEEL WIRE ROPE LOCK

BACKGROUND OF THE INVENTION

1. Field of the Invention

This invention relates to a steel wire rope lock, which can be easily operated to make the second end connector and the lock housing firmly combined together, particularly to which can prevent the second end connector from easily ejecting by the pulling force of the steel wire rope.

2. Description of the Related Art

A conventional steel wire rope lock with U.S. Pat. No. 5,568,740 is owned by the applicant of the present invention.

Referring to FIG. 8, the granted prior steel wire rope lock includes a lock housing 12 made of steel tube, a lock 17 fixed in one end portion of the housing 12, a steel wire rope 14 having one end connected movably with the other end of the housing 12 via a first end connector 15 and an annular member 13 and the other end fixed with a second connector 141. The second connector 141 is to be fitted in a lateral hole 121 of the housing 12 and able to be kept immovable, i.e. locked by deadbolt 171 having a deep groove 1711 moved up to engage the annular groove 1411 of the second connector 141. Then, the steel wire rope 14 wound around an object cannot be taken off unless the lock is unlocked with a key.

However, the combining manner of the above-mentioned conventional steel wire rope lock is not perfect enough in use. While being used, the second end connector 141 is fitted in the lateral hole 121 of the middle section of the lock housing 121. Because there is no catching device to fix the second end connector 141 in the lateral hole 121,the second end connector 141 and the lock housing 121 must be held by one hand of a user so as not to separate from each other; then, the second end connector 141 is locked in the lock 15 fitted in the lock housing 12 by the other hand of the user. It is neither convenient nor easy to operate.

Moreover, the second end connector 141 is inserted in the lock housing 12 without any catching device so that the second end connector 141 may suddenly eject by the pulling force of the steel wire rope 14 if a user should relax his/her hold. Therefore, the user may be frightened and even hit accidentally.

SUMMARY OF THE INVENTION

Therefore, an objective of this invention is to provide a steel wire rope lock which is convenient and easy to operate.

Another objective of this invention is to provide a steel wire rope lock which can prevent the second end connector from suddenly ejecting by the pulling force of the steel wire rope so as to prevent a user from being frightened and even hit accidentally.

Accordingly, a steel wire rope lock in the present invention includes a lock housing, a steel wire rope having a first end and a second end, a first end connector for fixing tightly the first end of the steel wire rope, a second end connector for fixing tightly the second end of the steel wire rope and a lock fitted in the lock housing. The first end connector is inserted into the mouth of the lock housing, and a resilient C-shaped ring clamping the annular groove is fitted in the dented annular groove of the mouth and half protrusive outside the annular groove. The lock is inserted in the other end of the lock housing and fixed by a pin penetrating the pin holes of the lock housing and the lock. Then, the second end connector is inserted into the lateral hole of the lock housing, and the steel bead provided half in the round hole of the second end connector is compressed by the inner wall of the lateral hole to withdraw wholly in the round hole. When the second end connector being inserted more downwardly, the steel bead will be pushed outward by the spring in the round hole to be caught in the arc groove. Thus, the second end connector is firmly fixed in the lock housing.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
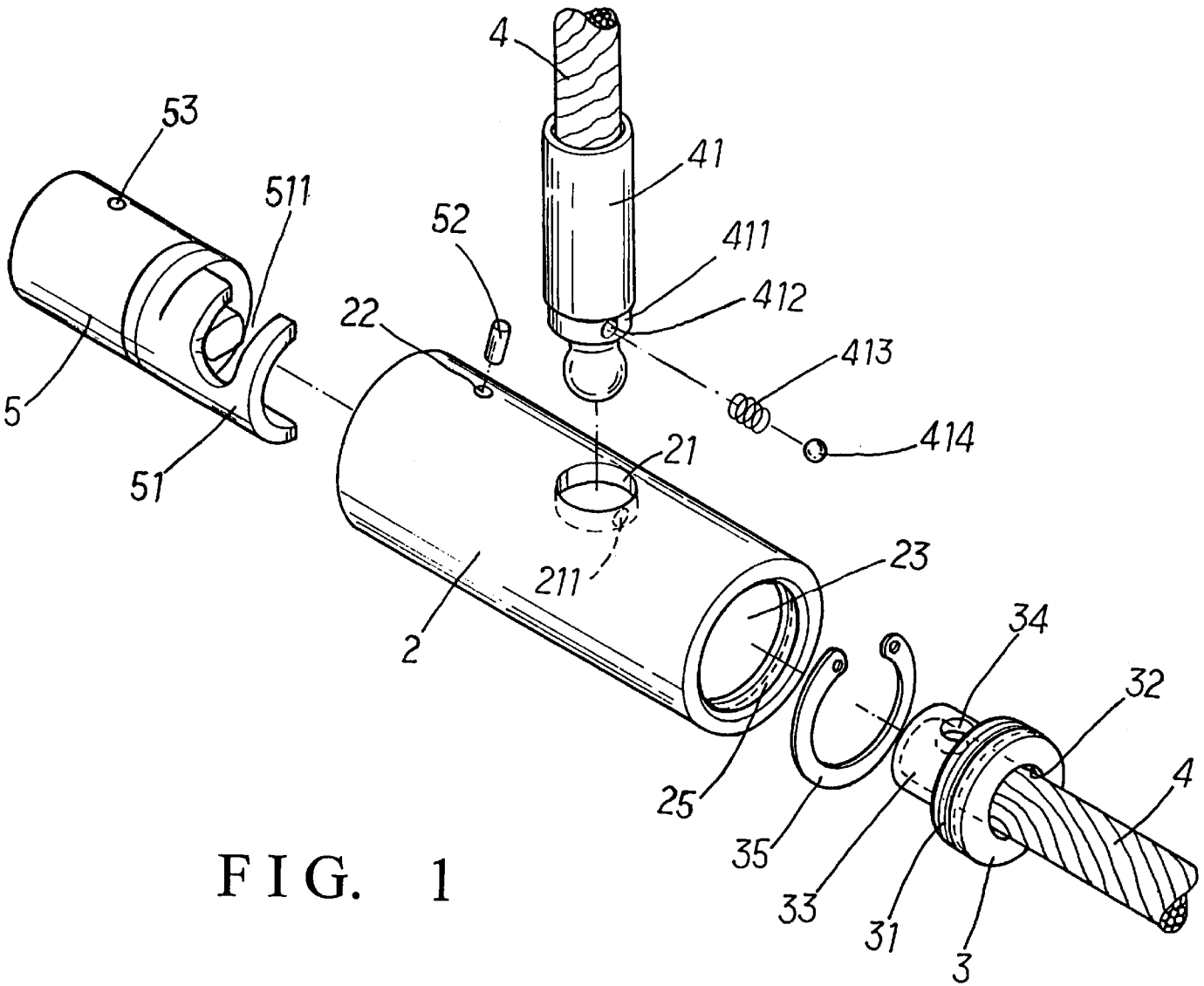
FIG. 1 is an exploded perspective view of a steel wire rope lock in the present invention.
Figure 3:
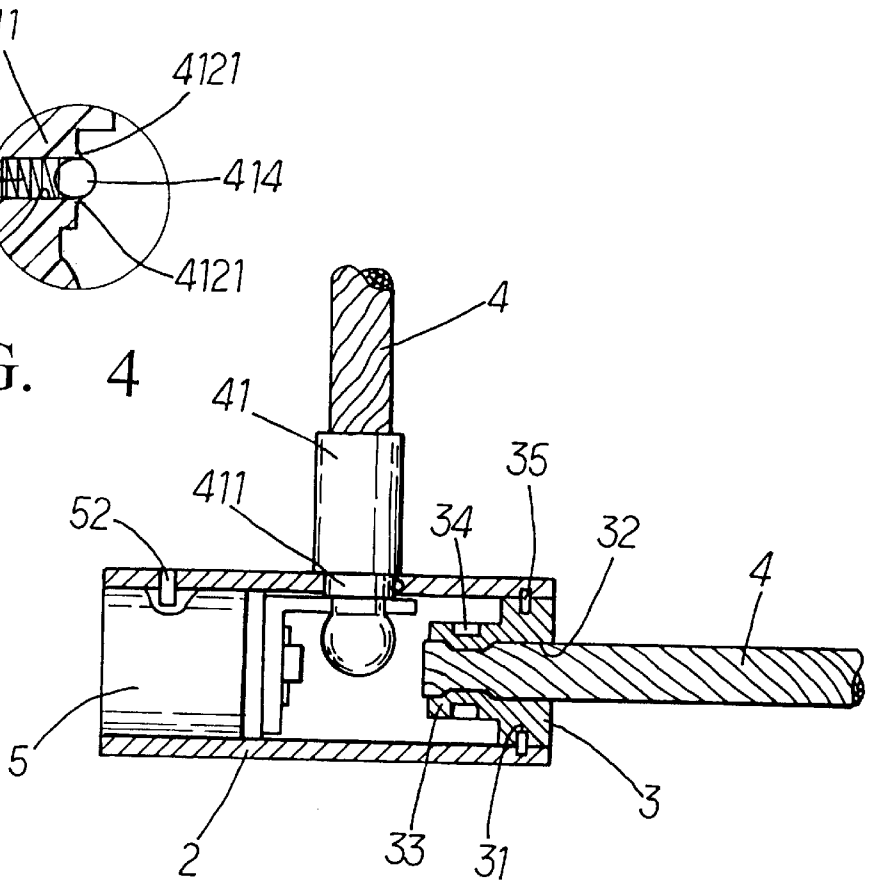
FIG. 3 is a cross-sectional combined view of the steel wire rope lock after the second end connector being locked in the lock housing in the present invention.
Figure 2:
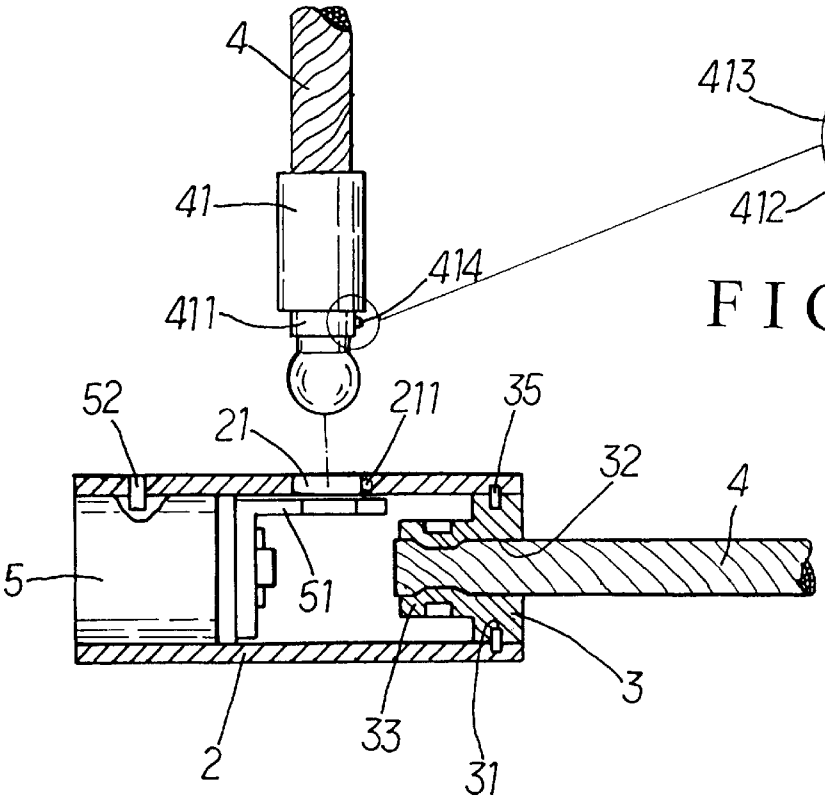
FIG. 2 is a cross-sectional combined view of the steel wire rope lock before the second end connector being locked in the lock housing in the present invention.

Referring to FIGS. 1, 2 and 3, a preferred embodiment of a steel wire rope lock in the present invention is composed by a lock housing 2, a first end connector 3, a steel wire rope 4 and a lock 5.

The lock housing 2 made of a steel tube with a thick wall is provided with a lateral hole 21 in the central portion and a pin hole 22 in one end. An arc groove 211 is provided in the inner wall of the lateral hole 21. A mouth 23 is provided in the other end of the lock housing 2, and a dented annular groove 25 is formed on the inner wall of the mouth 23.

The first end connector 3 is provided with an annular groove 31 on the outer surface for a resilient C-shaped ring 35 to clamp on. A center hole 32 of the first end connector 3 is provided for the first end of the steel wire rope 4 to fit through. An extending portion 33 is protrusive on the front end of the first end connector 3, and a recess 34 is provided in the extending portion 33.

Figure 4:
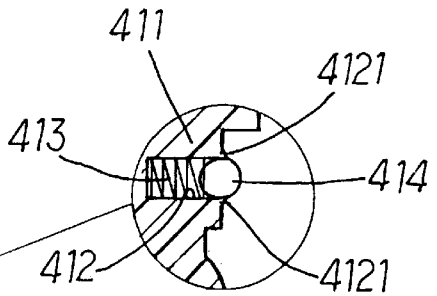
FIG. 4 is an enlarged cross-sectional view of the second end connector of the steel wire rope lock in the present invention.

The steel wire rope 4 has one end fitted in the center hole 32 of the first end connector 3 and the other end fitted in the second end connector 41. On the front end of the second end connector 41 is provided with a protruding pole 411 in whose outer wall is provided with a round hole 412 corresponding to the arc groove 211. The round hole 412 is provided for a spring 413 to be inserted into and then for a steel bead 414 to be inlaid. The steel bead 414 is caught by the upper flange 4121 of the round hole 412 and is prevented from wholly ejecting outward. Thus, the steel bead 414 will always be pushed by the spring 413 and slightly protrude outside the round hole 412, as shown in FIG. 4.

The lock 5 is provided with a catch member 51 in one end. The catch member 51 is provided with a deep groove 511. In the other side of the lock 5 is provided with a pin hole 53 corresponding to the pin hole 22 of the lock housing 2. A pin 52 is inserted through the pin holes 22 and 53 of the lock housing 2 and the lock 5 so as to secure the lock 5 in the lock housing 2.

Figure 6:
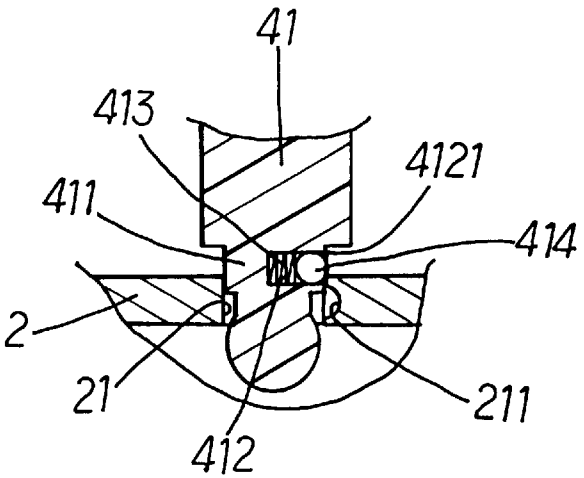
FIG. 6 is a cross-sectional view showing the steel bead being compressed in the round hole while the second end connector being inserted in the lateral hole of the lock housing of the steel wire rope lock in the present invention.
Figure 7:
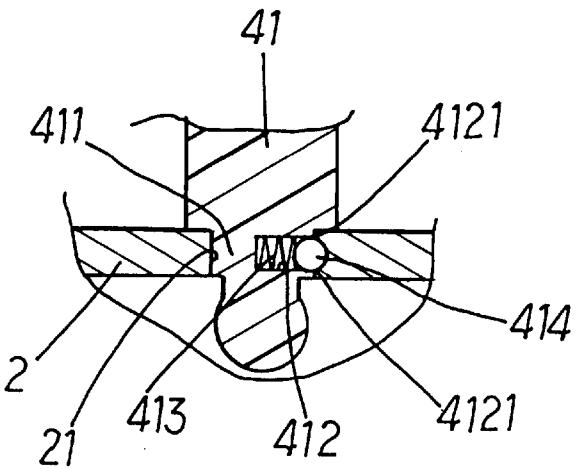
FIG. 7 is a cross-sectional view showing the condition of the steel bead of the second end connector when being caught in the arc groove of the lateral hole of the lock housing of the steel wire rope lock in the present invention; and, FIG. 8 is an exploded perspective view of a conventional steel wire rope lock whose U.S. Pat. No. is 5,568,740 and which was invented by the inventor of the present invention.
Figure 5:
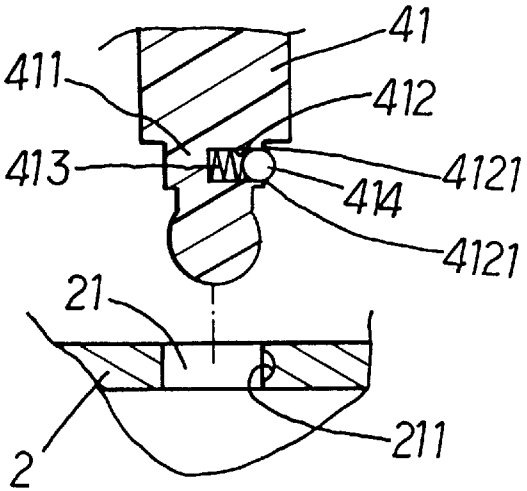
FIG. 5 is a cross-sectional view showing the condition of the steel bead of the second end connector before the second end connector being locked in the lock housing of the steel wire rope lock in the present invention.
Figure 8:
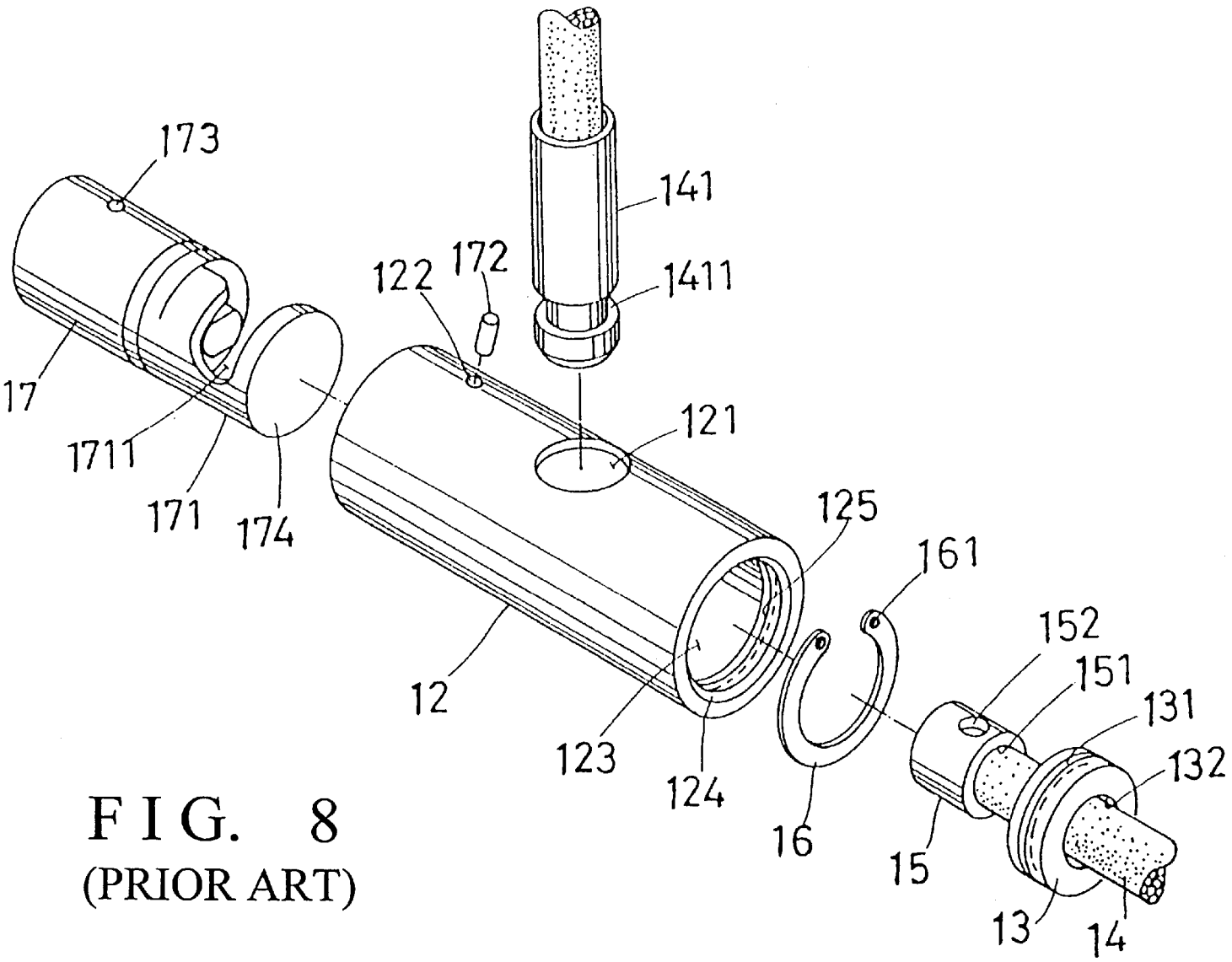
FIG. 8 (PRIOR ART)

In assembling, the first end connector 3 is inserted into the mouth 23 in one end of the lock housing 2, and the C-shaped ring 35 clamping on the annular groove 31 is inlaid in the dented annular groove 25 and half protrusive outside the annular groove 31. The lock 5 is inserted in the other end of the lock housing 2 and secured in the lock housing 2 by the pin 52 penetrating through the pin holes 22 and 53 of the lock housing 2 and the lock 5. Then, the second end connector 41 is inserted into the lateral hole 21 of the lock housing 2, as shown in FIG. 5. When the steel bead 414 being compressed by the inner wall of the lateral hole 21, the steel bead 414 will withdraw wholly in the round hole 412, as shown in FIG. 6. When the second end connector 41 being inserted more downwardly, the steel bead 414 will be pushed outward by the spring 413 and be caught in the arc groove 211, as shown in FIG. 7. Thus, the second end connector 41 is secured in the lock housing 2 and then is locked by the lock 5 in the lock housing 2.

As can be understood from the above description, the steel wire rope lock in the present invention has following merits:

1. It is convenient and easy to operate because the second end connector 41 can be secured in the lock housing 2 by the steel bead 414 being caught in the arc groove 211 in the inner wall of the lateral hole 21 without being held by one hand of a user.
2. The second end connector 41 will not eject outward by the pulling force of the steel wire rope 4 after the lock 5 being unlocked unless the second end connector 41 is pulled out to make the steel bead 414 be out of the arc groove 211.

While the preferred embodiments of the invention have been described above, it will be recognized and understood that various modifications may be made therein and the appended claims are intended to cover all such modifications which may fall within the spirit and scope of the invention.

What is claimed is:

1. A steel wire rope lock comprising:

a longitudinally extended lock housing formed of a steel tube having a bore extending longitudinally therethrough, said housing having a centrally disposed opening formed through a wall thereof, said opening being circumscribed by an annular edge portion of said wall having an arcuate recess formed therein;

a lock secured within said bore of said housing adjacent one end of said housing, said lock having a catch member extending from an end thereof, said catch member having an elongated opening formed therein in aligned relationship with said opening in said housing;

a steel wire rope having opposing first and second ends, said first end of said wire rope being secured to an end of said housing opposite said lock; and, a connector coupled to said second end of said steel wire rope and including a protruding pole adapted for passage into said opening of said housing and releasable locking engagement within said elongated opening of said catch member, said protruding pole having a hole formed in a side portion thereof aligned with said arcuate recess of said housing when said connector is disposed in said opening of said housing, said connector including a spring disposed in said hole and a steel bead disposed in said hole adjacent an open end thereof, said steel bead being retained in said hole by a flange portion of said hole and biased against said flange by said spring for extension of a portion of said steel bead from said open end of said hole, said connector being releasably held in said opening of said housing prior to said locking engagement of said protruding pole by said catch member responsive to said steel bead releasably engaging said arcuate recess of said housing when said connector is inserted into said opening of said housing.

* * * * *